US007303445B2

(12) United States Patent
Nakano et al.

(10) Patent No.: US 7,303,445 B2
(45) Date of Patent: Dec. 4, 2007

(54) CONNECTOR AND A CONNECTOR ASSEMBLY

(75) Inventors: Hiroshi Nakano, Yokkaichi (JP); Kenji Okamura, Yokkaichi (JP); Masahide Hio, Yokkaichi (JP); Hiroshi Kobayashi, Toyota (JP)

(73) Assignees: Sumitomo Wiring Systems, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 11/526,370

(22) Filed: Sep. 25, 2006

(65) Prior Publication Data

US 2007/0072462 A1 Mar. 29, 2007

(30) Foreign Application Priority Data

Sep. 26, 2005 (JP) ..... 2005-278570

(51) Int. Cl.
*H01R 13/64* (2006.01)

(52) U.S. Cl. ..... 439/680; 439/352; 439/572

(58) Field of Classification Search ..... 439/570–573, 439/680, 352
See application file for complete search history.

(56) References Cited

U.S. PATENT DOCUMENTS 5,533,908 A 7/1996 Henry et al.
5,547,385 A * 8/1996 Spangler ..... 439/101
6,030,249 A 2/2000 Illg
6,234,834 B1 * 5/2001 Tsai et al. ..... 439/541.5
6,254,429 B1 7/2001 Morita
6,343,951 B1 * 2/2002 Ono et al. ..... 439/571
6,699,069 B2 * 3/2004 Inoue ..... 439/570
6,709,288 B1 * 3/2004 Hung et al. ..... 439/570
6,722,925 B2 * 4/2004 Skofljanec ..... 439/680
2005/0124228 A1 6/2005 Nakano et al.

FOREIGN PATENT DOCUMENTS

JP 61-60486 4/1986
JP 2005-166491 8/2005

* cited by examiner

*Primary Examiner*—Truc Nguyen
(74) *Attorney, Agent, or Firm*—Gerald E. Hespos; Anthony J. Casella

(57) ABSTRACT

A male connector (M) is provided with a receptacle (10) and a female connector (F) is provided with a housing (40) that can fit into the receptacle (10) from the front. Mounting grooves (18) are formed by recessing both side walls (16) of the receptacle (10) and fixing members (30) are mounted into the mounting grooves (18). The fixing members (30) are fixed to a circuit board (80) by soldering. Engaging projections (49) bulge out sideways from the opposite side surfaces of the housing (40). Engaging grooves (19) are recessed in the inner side surfaces of the both side walls (16) of the receptacle (10) at positions before the mounting grooves (18) and engage with the engaging projections (49) as the connectors (F, M) are connected to resist a tensile force acting when the housing (40) is pulled away from the circuit board (80).

17 Claims, 10 Drawing Sheets

CONNECTOR AND A CONNECTOR ASSEMBLY

BACKGROUND OF THE INVENTION

1. Field of the Invention

The invention relates to a connector, in particular a circuit board connector, and to a connector assembly.

2. Description of the Related Art

Japanese Unexamined Utility Model Publication No. S61-60486 discloses a circuit board connector with a tubular receptacle and terminal fittings mounted in the receptacle. The receptacle has opposite side walls, and board fixing portions bulge out sideways from the bottom ends of the outer surfaces of the side walls. Screw holes are formed in the board fixing portions, and screws are inserted into the screw holes from beneath the board. The screws then are tightened to fix the connector on the board. The connector of Japanese Unexamined Utility Model Publication No. S61-60486 requires an undesirably large installation space on the circuit board due to the outwardly bulging board fixing portions.

Japanese Unexamined Patent Publication No. 2005-166491 discloses a miniaturized circuit board connector with a receptacle and mounting grooves recessed in the side walls of the receptacle. Fixing members are mounted in the mounting grooves and are soldered to the circuit board to fix the connector on the circuit board. The circuit board connector disclosed in Japanese Unexamined Patent Publication No. 2005-166491 achieves miniaturization in the width direction of the connector. However, a demand also exists to reduce the height of the connector.

A shorter connector can be achieved by thinning the upper or lower walls of the receptacle. However, a thin upper wall may crack or may break and roll up when an upward tensile force acts on the housing. Upward forces can be generated, for example, while fitting a mating housing into the receptacle or while pulling wires drawn out of the housing. A roll-up preventing means between the receptacle and the housing has been considered. However, an additional roll-up preventing structure could complicate the connector and could be inconsistent with the original demand to miniaturize the connector in the width and height directions.

The invention was developed in view of the above problem and an object is to prevent a receptacle from being rolled up without enlarging the connector.

SUMMARY OF THE INVENTION

The invention relates to a connector with a forwardly open receptacle for receiving a housing of a mating connector. At least one mounting groove is recessed in at least one side wall of the receptacle and at least one fixing member is mountable in the mounting groove. The fixing member can be fixed to an electric or electronic device, such as a circuit board. At least one engaging groove is recessed in at least one inner surface of the side wall of the receptacle at a position before the mounting groove. At least one engaging projection bulges out laterally from the housing of the mating connector and engages in the engaging groove as the connector is connected with the mating connector. This engagement resists a tensile force exerted on the upper wall when the housing is pulled away from the electric or electronic device. Thus, the upper wall of the receptacle is not likely to break and roll up even if the upper wall is thinned to reduce the height of the connector. Further, the engaging groove is formed efficiently in an area of the inner surface of the side wall of the receptacle before the mounting groove. Thus, the engaging groove does not widen the connector and does not require a redesign of the mounting groove. Furthermore, the lateral positions of the engaging groove and the engaging projection permits a wide terminal accommodating area in the housing.

The engaging groove preferably is formed substantially in a middle part of the side wall of the receptacle with respect to the height direction. This position of the engaging groove helps to avoid a warping deformation of the resin during molding and during use of the receptacle.

The fixing member preferably can be fixed to the electric or electronic device by soldering or press-fitting.

The engaging groove preferably is engageable with the engaging projection in a form-closing manner.

The engaging groove preferably has a substantially dovetail, L- or T-shaped cross section.

The fixing member preferably comprises at least one biting projection that bites in the inner side edge of the mounting groove.

The fixing member preferably has a step that contacts a step in the mounting groove to locate a mounting portion of the fixing member at a specified height with respect to the receptacle.

The receptacle preferably is made of a resin having a high heat resistance.

The invention also relates to a connector assembly comprising the above-described connector and a mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A circuit board connector assembly according to a first embodiment of the invention is illustrated in FIGS. 1 to 8. The assembly includes a male connector M that is mounted to a circuit board 80 and a female connector F that can be connected to the male connector M. Ends of the connectors M, F that are connectable to one another are referred to herein as the front ends, and reference is made to FIG. 3 concerning the vertical direction.

Figure 5:
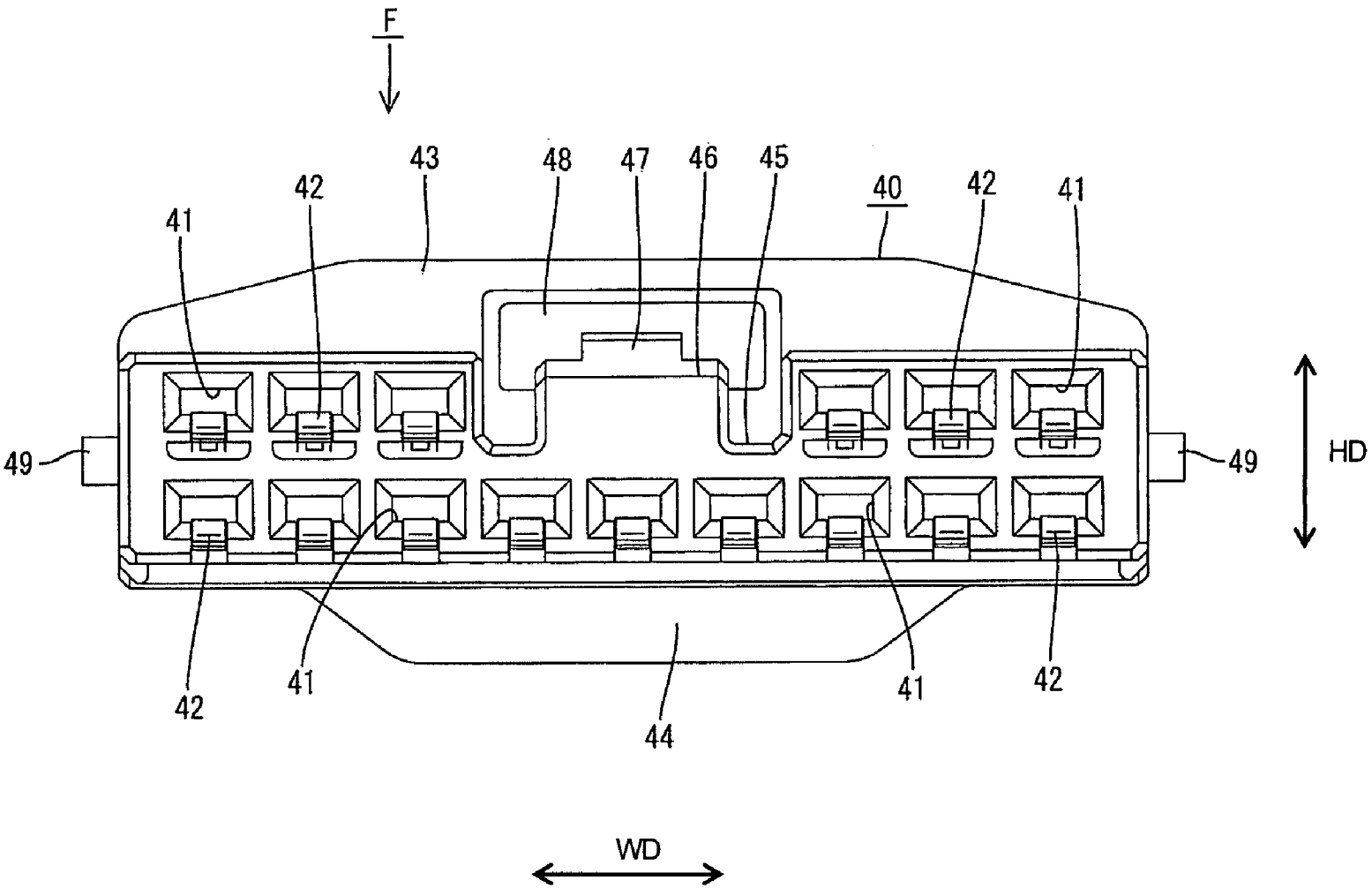
FIG. 5 is a front view of the female connector.

The female connector F includes a housing 40 made e.g. of a synthetic resin. The housing 40 is a wide rectangular block that is formed internally with cavities 41, as shown in FIG. 5. The cavities 41 are arranged at upper and lower stages so that the cavities 41 at each stage are substantially side-by-side in a width direction WD. Additionally, the cavities 41 are arranged in pairs along a height direction HD that extends substantially normal to the width direction WD. Female terminal fittings are connected with ends of unillustrated wires and are inserted respectively into the cavities 41 of the housing 40 from behind and along an insertion direction. The female terminal fittings are retained in the cavities 41 by locks 42 that project substantially forward along the bottom surfaces of the cavities 41. The lower surfaces of the locks 42 of the lower stage cavities 42 are exposed at the lower surface of the housing 40 to reduce the height of the connector.

Figure 3:
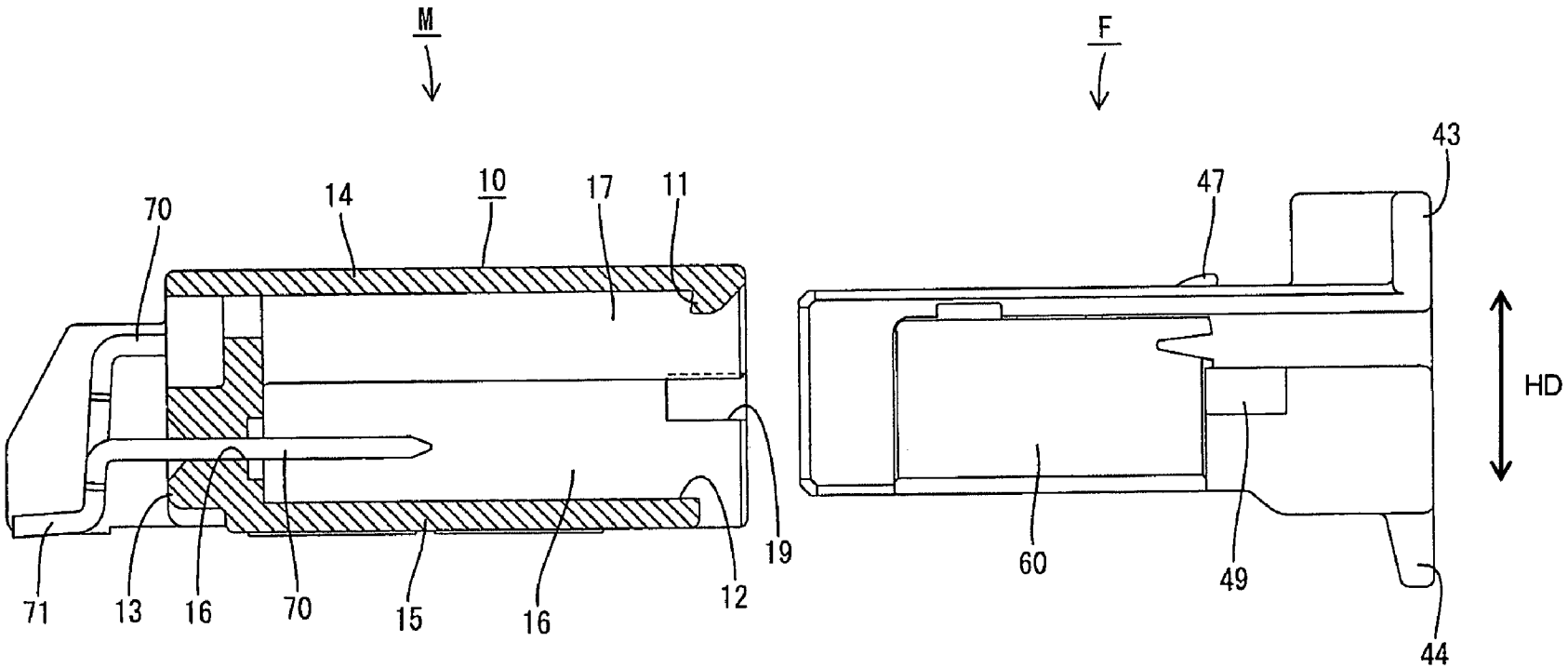
FIG. 3 is a side view of the two connectors before being connected with only the receptacle of the male connector shown in section.

A retainer 60 is mounted through a side surface of the housing 40, as shown in FIG. 3. The mounted retainer 60 at least partly crosses the cavities 41 and supplements the locks 42 for doubly locking the properly inserted female terminal fittings in the cavities 41. Grips 43, 44 bulge up and down near the rear ends of the upper and lower surfaces of the housing 40 to facilitate manual gripping of the housing 40 as the female connector F is being connected with or separated from the male connector M.

A recess 45 is formed substantially in the widthwise center of the upper surface of the housing 40 at a position slightly lower than the cavities 41 at the upper stage. Thus, these cavities 41 are at opposite sides of the recess 45. A lock arm 46 is cantilevered rearwardly from a location in the recess 45 near the front end of the housing 40. The lock arm 46 is resiliently deformable up and down towards and away from the housing 40. A lock 47 projects from the upper surface of the lock arm 46 and is engageable with corresponding structure on the male connector M to hold the two connectors F, M together. An operable portion 48 is provided near the rear end of the lock arm 46 and may be used to unlock the lock arm 46. The operable portion 48 is at least partly enclosed by an arched or bridged part of grip 43. Thus, the grip 43 prevents the operable portion 48 from getting caught by a looped wire or the like in a way that could roll or deform the operable portion 48 up and out.

Left and right engaging projections 49 bulge laterally out from the opposite side surfaces of the housing 40 at positions near the rear end of the housing 40 and at substantially middle positions on the side surfaces with respect to the height direction HD. The engaging projections 49 are substantially identical rectangular ribs that extending in forward and backward directions at substantially the same height positions.

Figure 6:
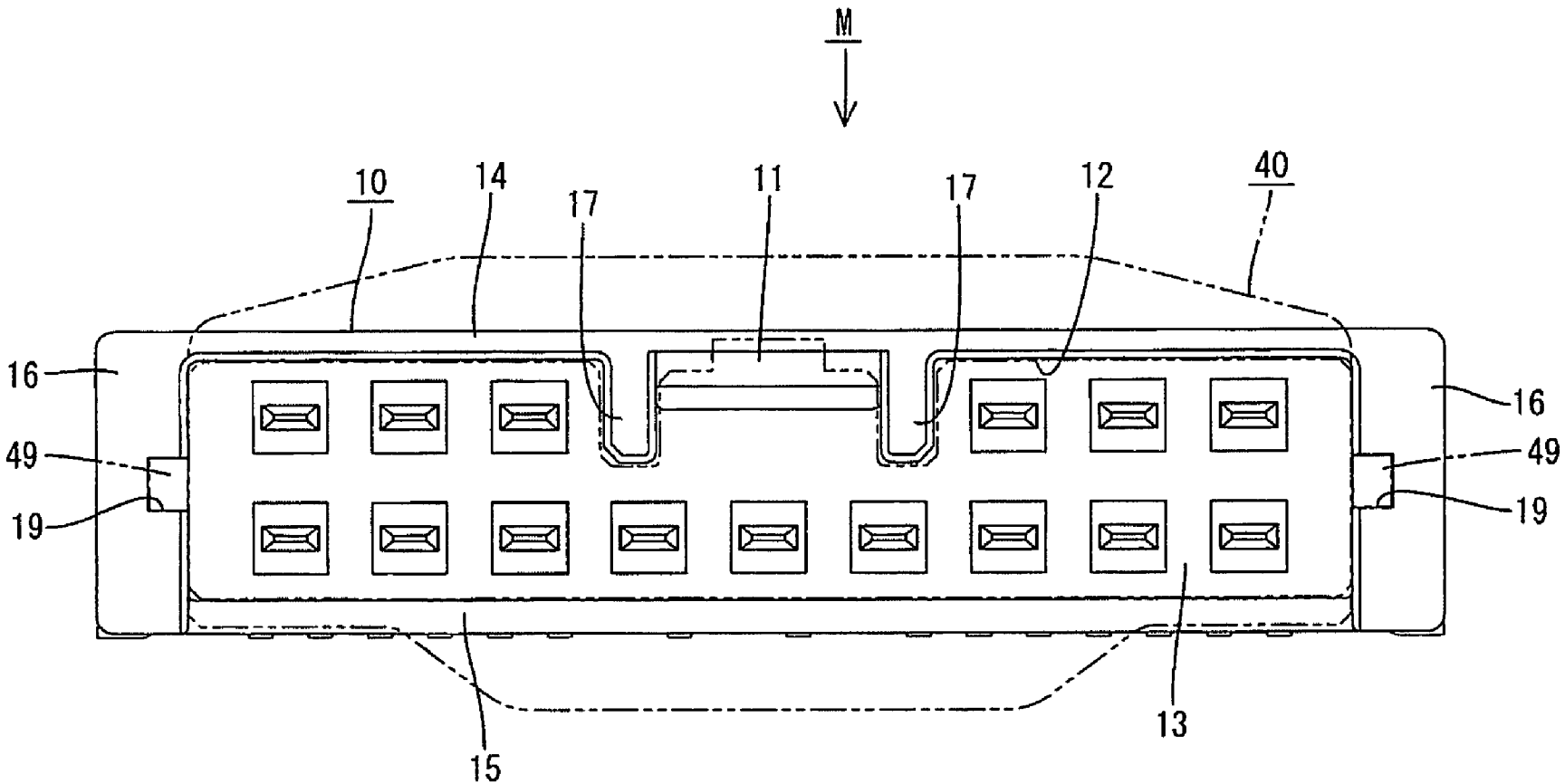
FIG. 6 is a front view of the male connector.

The male connector M includes a receptacle 10 that is made of a resin having a high heat resistance, such as an LCP (liquid crystal polymer) or PEEK (Polyetheretherketone). A wide substantially rectangular tubular fitting recess 12 extends into the front end of the receptacle 10, as shown in FIGS. 3 and 6, and is configured for receiving the mating housing 40. The fitting recess 12 has a wide substantially rectangular back wall 13. Upper and lower walls 14, 15 and left and right walls 16 project forward from the outer periphery of the back wall 13. The upper and lower walls 14, 15 are to be arranged substantially parallel to the printed circuit board 80 and are thinner than the left and right walls 16 to reduce the height of the receptacle 10. The back wall 13 of the receptacle 10 is formed with terminal insertion holes 16 that are arranged at upper and lower stages at positions corresponding to the cavities 41 of the housing 40. Front ends of male terminal fittings 70 are inserted through the terminal insertion hole 16 and project into the fitting recess 12.

The rear part of each male terminal fitting 70 projects back from the back wall 13, is bent down or towards the circuit board 80 at a substantially right angle at a specified position. Each male terminal fitting 70 then is bent back at a substantially right angle at substantially the same position as the bottom surface of the housing 40 to define a connecting portion 71. The connecting portions 71 of the male terminal fittings 70 can be connected with corresponding conductor paths on the circuit board 80 by soldering, ultrasonic welding, press-fitting, insulation displacement or the like when the housing 40 is placed on the circuit board 80.

A lock 11 projects down from a widthwise intermediate position of the inner surface of the upper wall 14 of the receptacle 10 and is engageable with the lock arm 46 of the mating housing 40. Left and right downwardly projecting guides 17 extend in forward and backward directions at opposite sides of the lock 11 and are unitary with the lock 11. The guides 17 can slidably engage opposite sides of the lock arm 46 to help guide the insertion of the housing 40 into the receptacle 10. The terminal insertion holes 16 at the upper stage are arranged at opposite sides of an area where the two guides 17 and the lock portion 11 are formed.

Figure 8:
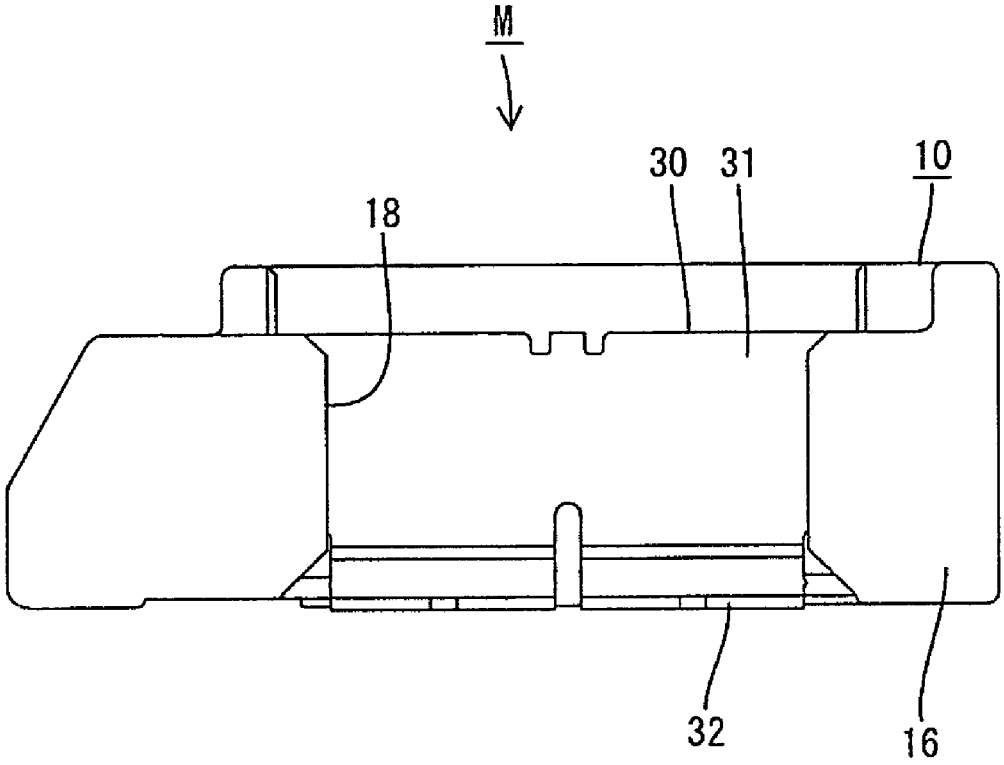
FIG. 8 is a side view of the male connector.

Fixing members 30 are mounted to the opposite side walls 16 of the receptacle 10 for fixing the receptacle 10 to the circuit board 80 by soldering, clamping, press-fitting or the like. Each fixing member 30 is formed by press-working a unitary metal plate to define an L-shape, as shown in FIG. 8. The L-shape of each fixing member 30 is defined by a main portion 31 arranged substantially along the corresponding side wall 16, and a mounting portion 32 that extends substantially perpendicularly from the bottom of the main portion 31 for placement on the circuit board 80. Although not shown in detail, the main portion 31 has a stepped shape with at least two widths that are narrowed from the top to the bottom. Unillustrated biting projections bulge out from opposite side edges of an intermediate part of the main portion 31.

Figure 7:
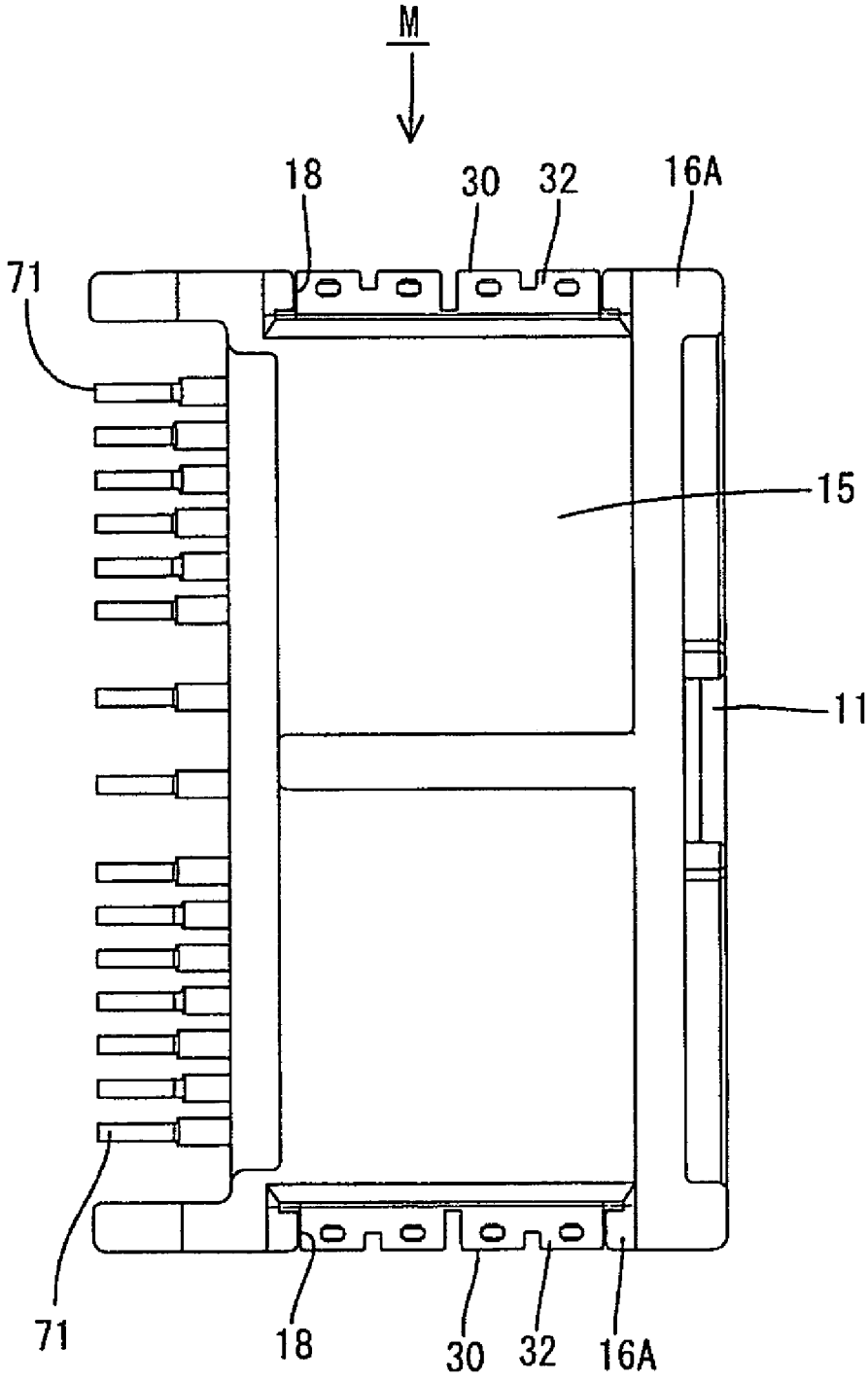
FIG. 7 is a bottom view of the male connector.

Mounting grooves 18 are formed in the outer surfaces of the side walls 16 of the receptacle 10 at intermediate parts of the side walls 16 with respect to forward and backward directions. As shown in FIG. 7, each mounting groove 18 is recessed inwardly by about half the thickness of the side wall 16 to define a large space dimensioned to receive the main portion 31. The main portion 31 of the fixing member 30 is inserted into the mounting groove 18 from above, and is pushed so that the biting projections bite in the inner side edges of the mounting groove 18. Steps of the main portion 31 engage corresponding steps of the inner edges of the mounting groove 18 to limit the downward movement. As a result the mounting portion 32 is at or slightly below the height of the lower surface of the bottom wall 15 of the receptacle 10 and the fixing member 30 is retained in the mounting groove 18.

Left and right engaging grooves 19 are recessed in the inner surfaces of the opposite side walls 16 of the receptacle 10 and extend rearward from the front edge of the receptacle 10. The engaging grooves 19 are in areas 16A before the mounting grooves 18 and are in intermediate parts of the side walls 16 with respect to the height direction HD. Additionally, the engaging grooves 19 lie within the thickness ranges of the side walls 16, and do not communicate with the mounting grooves 18.

The disposition of the engaging grooves 19 in the intermediate parts of the side walls 16 with respect to the height direction HD helps prevent warping deformation as the resin is set and also during reflow soldering in a high temperature atmosphere.

The engaging grooves 19 are disposed and shaped to correspond to the engaging projections 49 of the mating housing 40. Thus, the engaging projections 49 can slide along the engaging grooves 19 as the two connectors M, F are connected. The mating engagement of the engaging grooves 19 and the engaging projections 49 reduces the action a tensile force that could roll the upper wall 14 of the receptacle 10, thereby enhancing the tensile strength of the entire male connector M.

The fixing members 30 are inserted into the mounting grooves 18 of the receptacle 10, as described above. Additionally, solder is applied to portions on the surface of the circuit board 80 that are to be soldered. The receptacle 10 then is placed at a specified position on the surface of the circuit board 80 so that the connecting portions 71 of the male terminal fittings 70 are placed on the solder applied positions and the mounting portions 32 of the fixing members 30 similarly are placed at solder applied positions.

The circuit board 80 having the male connector M placed thereon then is passed through an unillustrated reflow furnace. Thus, the solder applied beforehand to the circuit board 80 is molten and adheres to the connecting portions 71 of the male terminal fittings 70 and to the mounting portions 32 of the fixing members 30. The solder then is cooled and solidified. As a result, the connecting portions 71 of the male terminal fittings 70 are secured and connected electrically to the corresponding conductor paths, and the mounting portions 32 of the fixing portions 30 are fixed to the circuit board 80 to mount the receptacle 10 on the circuit board 80.

Figure 1:
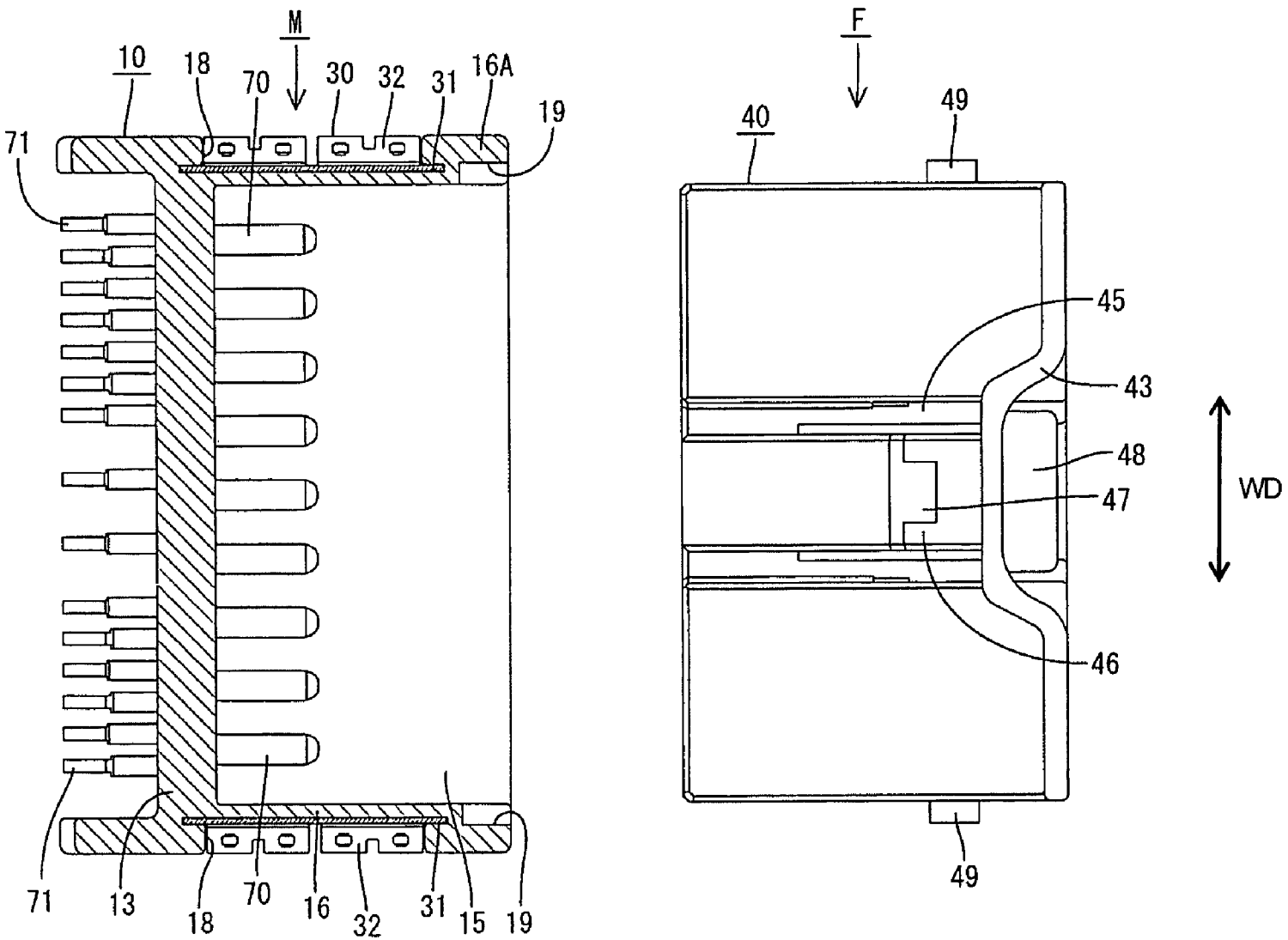
FIG. 1 is a plan view, partly in section, of male and female connectors according to a first embodiment before being connected.
Figure 2:
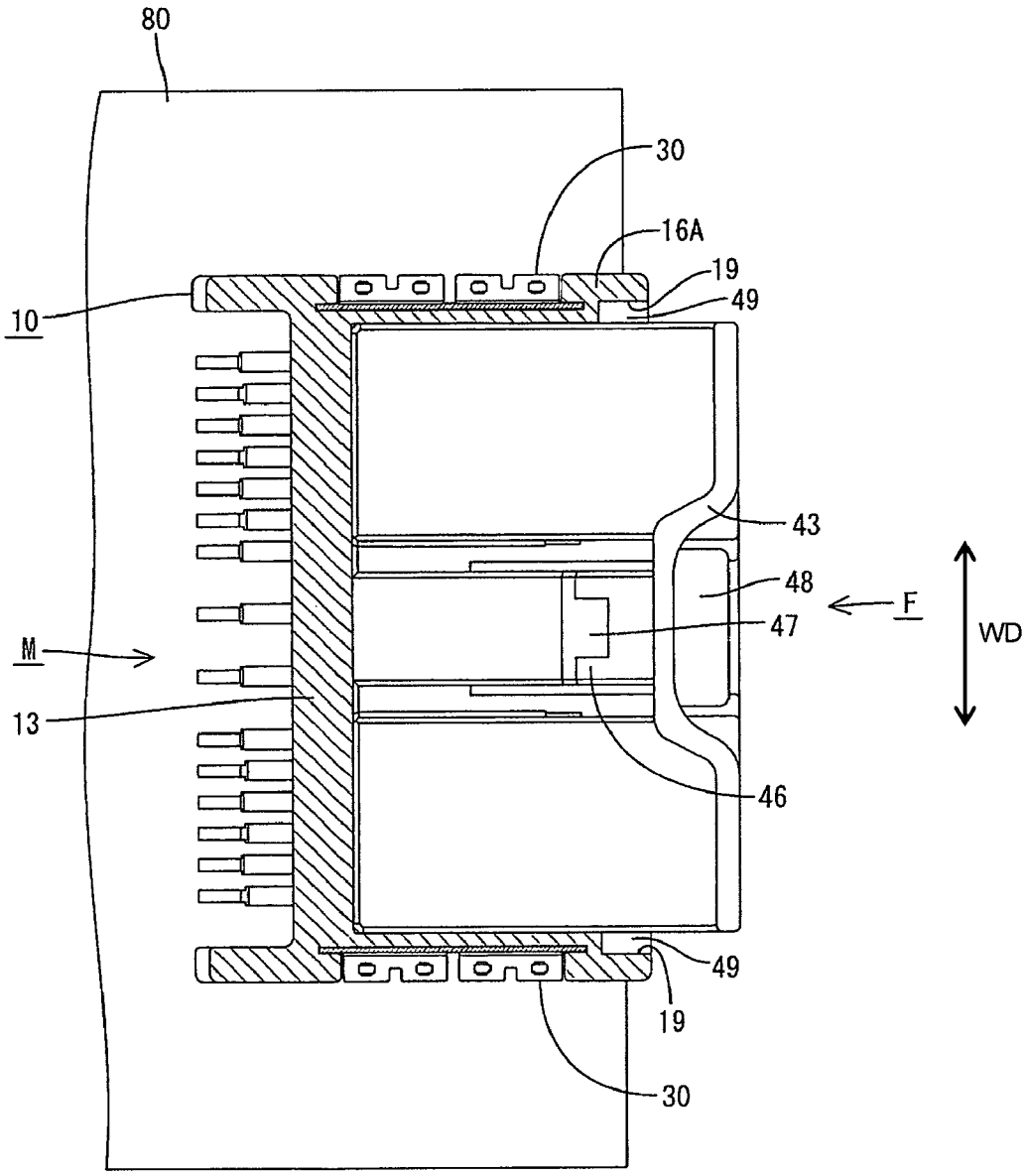
FIG. 2 is a plan view of the connected two connectors with only the receptacle of the male connector shown in section.

The housing 40 next is fit into the fitting recess 12 of the receptacle 10 in the state shown in FIGS. 1 and 3. As a result, the engaging projections 49 of the housing 40 enter the engaging grooves 19 of the receptacle 10. More particularly, the engaging projections 49 and the engaging grooves 19 closely engage towards a final stage of the connecting operation of the two connectors F, M (see FIG. 6). The lock arm 46 engages the lock 11 when the connectors F, M reach the properly connected position shown in FIGS. 2 and 4 to hold the connectors F, M together.

Figure 4:
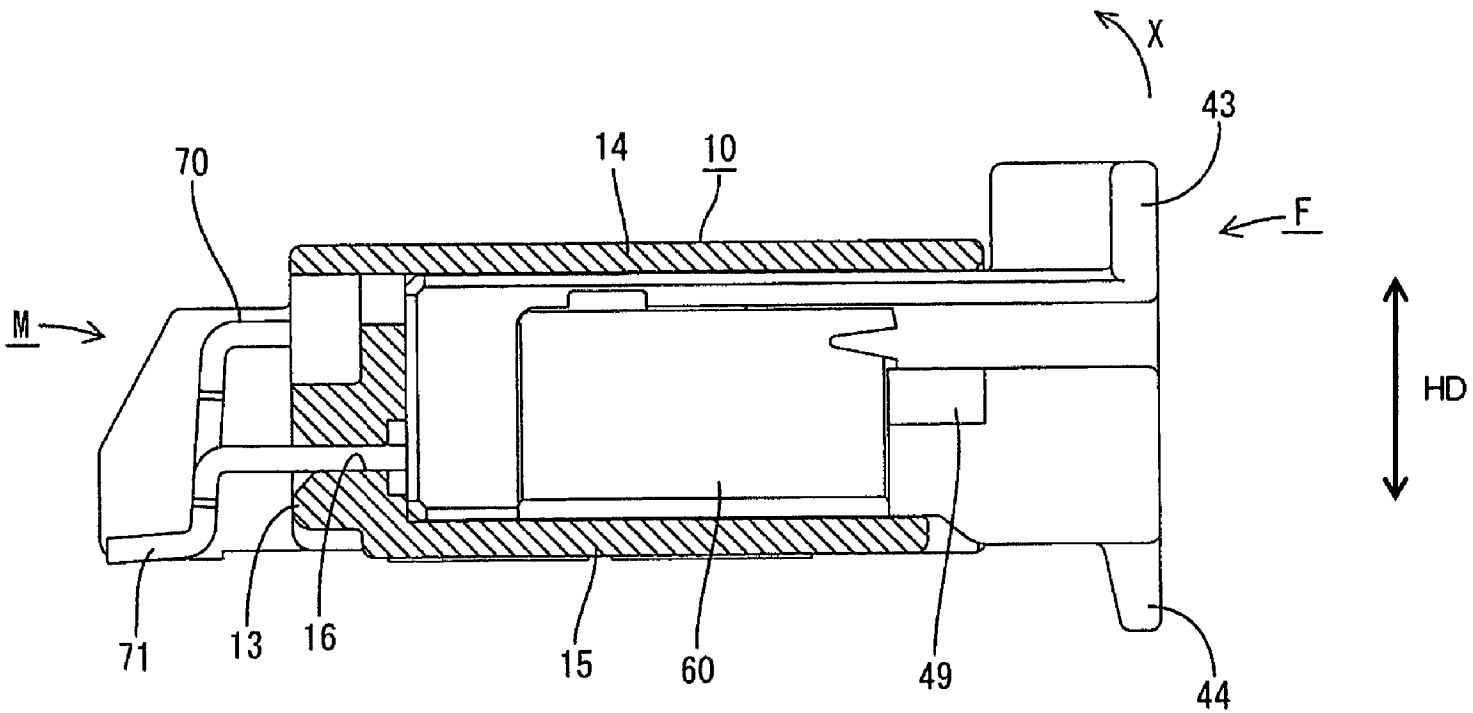
FIG. 4 is a side view of the connected two connectors with only the receptacle of the male connector shown in section.

A tensile force could act to pull the housing 40 in a pulling direction of arrow X in FIG. 4 if, for example, wires drawn out through the rear surface of the housing 40 are pulled up. Thus, a force acts in a direction that could cause the upper wall 14 of the receptacle 10 to roll up. However, the engaging projections 49 are engaged with the engaging grooves 19 in the pulling direction. As a result, a tensile force concentrates on the engaged portions to prevent the upper wall 14 of the receptacle 10 from being rolled up and out.

The engaging grooves 19 are located efficiently in the areas 16A of the side walls 16 of the receptacle 10 before the mounting grooves 18. Thus, it is not necessary to change the depth or shape of the mounting grooves 18 to form the engaging grooves 19. Additionally, the engaging grooves 19 do not bulge out sideways from the outer surfaces of the opposite side walls 16 of the receptacle 10 and hence do not increase the width of the receptacle 10. Further, since the engaging projections 49 bulge out sideways from the opposite side surfaces of the housing 40, an area large in the width direction WD is available to form the cavities 41 in the housing 40.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Figure 9A:
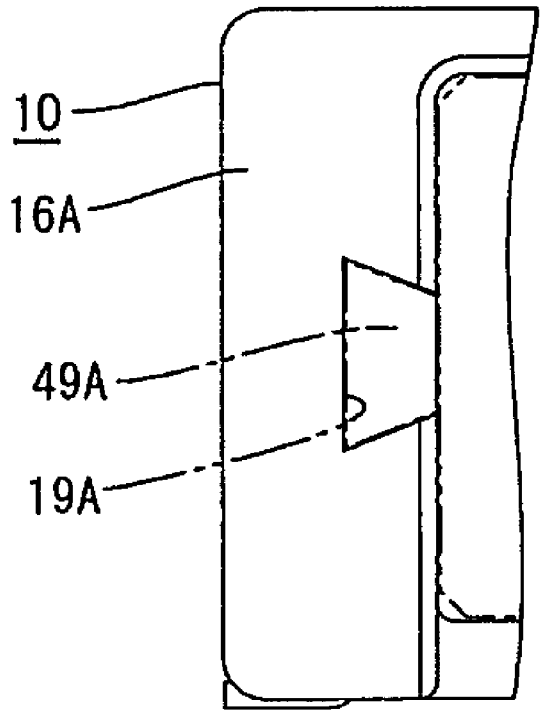
FIG. 9A is an enlarged front view of an engaged state of an engaging projection and an engaging groove of a second embodiment.
Figure 9B:
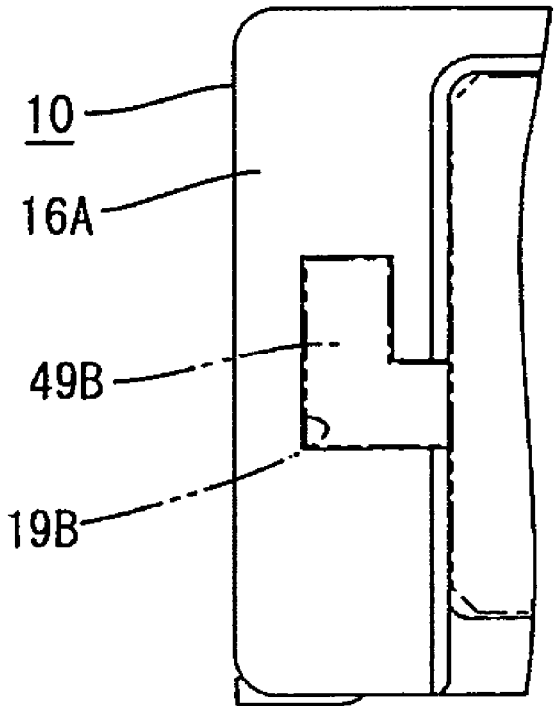
FIG. 9B is an enlarged front view showing an engaged state of an engaging projection and an engaging groove of a third embodiment.
Figure 9C:
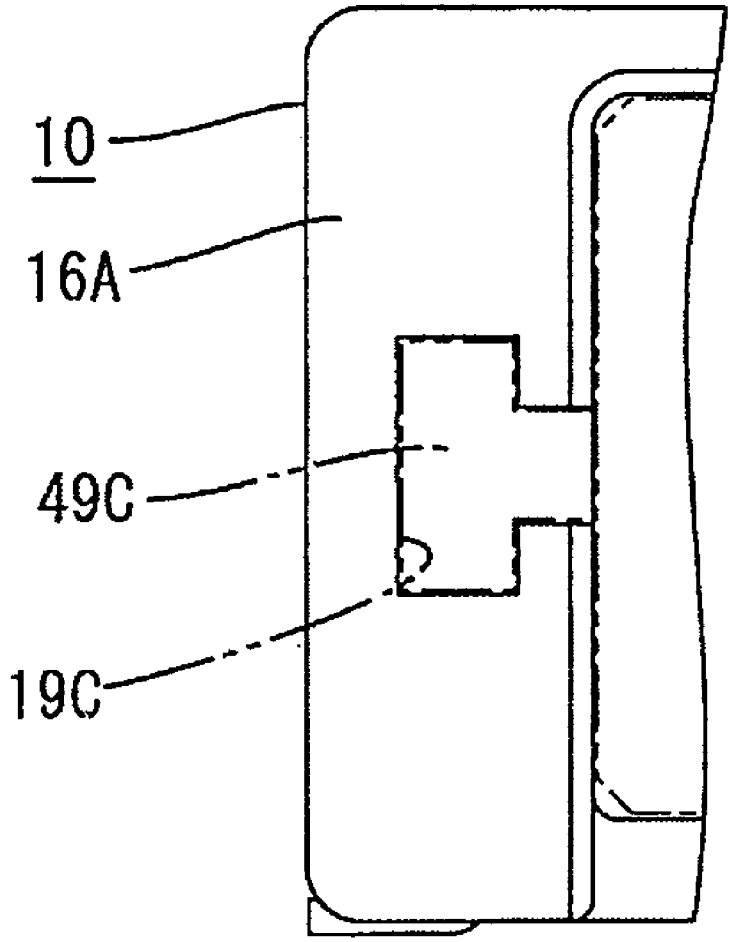
FIG. 9C is an enlarged front view showing an engaged state of an engaging projection and an engaging groove of a fourth embodiment.

The engaging projections and the engaging grooves have substantially rectangular cross sections in the foregoing embodiment. However, engaging projections 49A and engaging grooves 19A may have dovetailed or undercut cross sections and may engage each other as shown in FIG. 9A. Alternatively, engaging projections 49B and engaging grooves 19B may have bent or L-shaped cross sections as shown in FIG. 9B or engaging projections 49C and engaging grooves 19C may have substantially T-shaped cross sections as shown in FIG. 9C. The constructions shown in FIGS. 9A to 9C increase areas of engagement between the engaging projections 49A, 49B, 49C and the engaging grooves 19A, 19B, 19C, thereby further enhancing the tensile strength of the receptacle 10.

The male terminal fittings are connected with the circuit board by soldering in the foregoing embodiment. However, the invention also applies to connectors with male terminal fittings press fit into through holes formed in a circuit board. The male terminal fittings need not define L shapes and may be straight or may have different bent shapes.

The invention is applicable to connectors with male terminal fittings in a housing and female terminal fittings in a receptacle.

The invention is also applicable to connectors to be fixed to electric or electronic devices other than printed circuit boards such as junction boxes, dashboard panels, fuse boxes, relay boxes or the like.

What is claimed is:

1. A connector comprising a receptacle having opposite front and rear ends and at least one side wall extending from the front end towards the rear end, a fitting recess extending into the front end of the receptacle for receiving a housing of a mating connector, at least one mounting groove formed in an outer surface of the side wall of the receptacle rearward of the front end, at least one fixing member mounted in the mounting groove and configured to be fixed to an electric or electronic device, and at least one engaging groove formed in a surface of the side wall of the receptacle facing into the fitting recess and spaced inwardly from the outer surface of the side wall, the engaging groove extending from the front end of the receptacle to a position forward of the mounting groove, the engaging groove being engageable with at least one engaging projection bulging from the housing of the mating connector as the connector is connected with the mating connector to resist a tensile force acting when the housing is pulled in a direction away from the electric or electronic device.

2. The connector of claim 1, wherein the engaging groove is formed substantially in a middle part of the side wall of the receptacle with respect to a height direction.

3. The connector of claim 1, wherein the fixing member is configured to be fixed to the device by soldering or press-fitting.

4. The connector of claim 1, wherein the engaging groove is dimensioned for close engagement with the engaging projection.

5. The connector of claim 1, wherein the engaging groove has a substantially dovetail, L- or T-shaped cross section.

6. The connector of claim 1, wherein the fixing member 30 comprises at least one biting projection that bites in an inner surface of the mounting groove.

7. The connector of claim 1, wherein when the fixing member has a main portion formed with at least one step for engaging at least one step of the mounting groove when a mounting portion of the fixing member is at or below a height corresponding to a bottom surface of the receptacle.

8. The connector of claim 1, wherein the receptacle is made of a resin having a high heat resistance.

9. A connector comprising a receptacle having a front end, opposed top and bottom walls along a height direction and opposed first and second side walls extending between the top and bottom walls, a fitting recess extending into the front end of the receptacle outwardly open first and second mounting grooves formed respectively in outer surfaces of the first and second side walls of the receptacle and extending in substantially top-to-bottom directions at positions rearward of the front end of the receptacle, first and second engaging grooves formed respectively in surfaces of the first and second side walls of the receptacle facing into the fitting recess and spaced inwardly from outer surfaces of the walls, the engaging grooves extending from the front end of the receptacle to positions forward of the respective first and second mounting grooves.

10. The connector of claim 9, wherein the engaging grooves have rear ends spaced forward of the mounting grooves.

11. The connector of claim 10, wherein the engaging grooves are spaced substantially equally from the top and bottom walls of the receptacle.

12. The connector of claim 10, wherein each of the engaging grooves has a substantially dovetail, L- or T-shaped cross section.

13. A connector assembly comprising:

a first connector having a receptacle with a front end, the receptacle having opposed top and bottom walls spaced from one another along a height direction, opposed side walls spaced from one another along a width direction and extending between the top and bottom walls, a fitting recess extending into the front end of the receptacle, outwardly open mounting grooves formed respectively in the side walls of the receptacle and extending in the height direction at positions rearward of the front end of the receptacle, engaging grooves formed respectively in surfaces of the side walls facing into the fitting recess and spaced inwardly from outer surfaces of the side walls, the engaging grooves extending from the front end of the receptacle to positions forward of the respective mounting grooves, fixing members mounted in the respective mounting grooves and configured for mounting the receptacle on a device; and a second connector having a housing with a front end configured for mounting in the fitting recess of the receptacle, engaging projections bulging in the width direction from the housing at positions rearward of the front end of the housing, the engaging projections being engaged in the engaging grooves of the receptacle when the housing is mounted properly in the fitting recess.

14. The connector assembly of claim 13, wherein the second connector comprises a lock arm which is engageable with a lock of the first connectors to hold the two connectors in a properly connected state.

15. The connector assembly of claim 13, wherein the engaging grooves have rear ends spaced forward of the mounting grooves.

16. The connector assembly of claim 13, wherein the engaging grooves are spaced substantially equally from the top and bottom walls of the receptacle.

17. The connector assembly of claim 13, wherein each of the engaging grooves has a substantially dovetail, L- or T-shaped cross section.

* * * * *